US008566966B2

(12) United States Patent
DiSanto et al.

(10) Patent No.: US 8,566,966 B2
(45) Date of Patent: Oct. 29, 2013

(54) PANTS WITH WAISTBAND HAVING REINFORCED BELT LOOP

(75) Inventors: Daniel M. DiSanto, Alameda, CA (US); Stefano Aldighieri, Los Angeles, CA (US)

(73) Assignee: Ariat International, Inc., Union City, CA (US)

( * ) Notice: Subject to any disclaimer, the term of this patent is extended or adjusted under 35 U.S.C. 154(b) by 0 days.

(21) Appl. No.: 13/167,940

(22) Filed: Jun. 24, 2011

(65) Prior Publication Data

US 2011/0247128 A1 Oct. 13, 2011

Related U.S. Application Data

(63) Continuation of application No. 12/358,110, filed on Jan. 22, 2009, now Pat. No. 8,001,621.

(51) Int. Cl.
*A41D 1/06* (2006.01)
*A41D 13/02* (2006.01)

(52) U.S. Cl.
USPC ..... 2/227; 2/79

(58) Field of Classification Search
USPC ..... 2/79, 227, 231, 236
See application file for complete search history.

(56) References Cited

U.S. PATENT DOCUMENTS

| | | | | |
|---|---|---|---|---|
| 148,193 | A * | 3/1874 | Dunbar | 2/229 |
| 365,283 | A * | 6/1887 | Todd | 2/229 |
| 1,288,673 | A | 12/1918 | Potterf | |
| 1,568,329 | A | 1/1926 | Greenberg | |
| 2,742,647 | A | 4/1956 | Khalil | |
| 3,099,266 | A | 7/1963 | Spitzer | |
| 3,487,473 | A | 1/1970 | Janhsen | |
| 3,545,446 | A | 12/1970 | Nobbs | |
| 3,703,008 | A | 11/1972 | Hudson | |
| 4,400,832 | A | 8/1983 | Kinder | |
| 4,523,337 | A | 6/1985 | Leibowitz | |
| 5,023,957 | A | 6/1991 | Harvey | |
| 5,255,835 | A * | 10/1993 | Burks | 224/666 |
| 6,167,572 | B1 | 1/2001 | Naumovitz | |
| 6,243,880 | B1 | 6/2001 | Lyden | |
| D473,694 | S | 4/2003 | Lyden | |
| D565,280 | S | 4/2008 | Nikolayev | |
| D606,284 | S | 12/2009 | Caten et al. | |
| 2006/0107441 | A1* | 5/2006 | Houdroge | 2/227 |
| 2007/0136930 | A1* | 6/2007 | Dipietro | 2/227 |
| 2009/0210997 | A1 | 8/2009 | Birtch | |

FOREIGN PATENT DOCUMENTS

| | | |
|---|---|---|
| FR | 2869765 | 11/2005 |
| GB | 1413234 | 11/1975 |

OTHER PUBLICATIONS

English-language abstract of French Patent No. 2,869,765, European Patent Office, Nov. 11, 2005.

* cited by examiner

*Primary Examiner* — Amber Anderson
(74) *Attorney, Agent, or Firm* — Kilpatrick Townsend & Stockton LLP

(57) ABSTRACT

Pants include a waistband shaped to descend from the hip region to a rear center region, thereby resembling a shallow v-shape. The rear center region is configured to reach toward the back of the individual wearing the pants. A reinforcement patch is used to provide foundation to connect a belt loop to the waistband.

21 Claims, 4 Drawing Sheets

PANTS WITH WAISTBAND HAVING REINFORCED BELT LOOP

RELATED APPLICATION

The present application is a continuation patent application that claims priority under 35 U.S.C. §120 to U.S. patent application Ser. No. 12/358,110, entitled "Pants with V-Shaped Waistband," which was filed on Jan. 22, 2009, and the complete disclosure of which is hereby incorporated by reference herein.

FIELD OF THE INVENTION

This invention relates generally to apparel. More particularly, this invention relates to pants with a v-shaped waistband for a closer fit to a waist, particularly in the center back region.

BACKGROUND OF THE INVENTION

FIG. 1 illustrates a typical prior art waistband formed from a single rectangular strip of material 100. FIG. 2 illustrates pants 200 with the strip 100 sewn to a pant leg 202, which includes a pocket 204. This prior art pant configuration frequently results in a "back gap", shown by arrow 206. The back gap is the region between the waistband and the back of the individual (not shown) wearing the pants 200. This back gap is particularly apparent when the individual wearing the pants 200 is in a sitting position.

Some pants utilize an elastic waistband to address the back gap problem. Many individuals find elastic waistbands aesthetically unpleasant.

Therefore, it would be desirable to provide a new pant configuration that minimizes back gap, while maintaining aesthetically desirable qualities.

SUMMARY OF THE INVENTION

Pants include a waistband shaped to descend from the hip region to a rear center region, thereby resembling a shallow v-shape. The rear center region is configured to reach toward the back of the individual wearing the pants. In one embodiment, a reinforcement patch is used to provide foundation to connect a belt loop to the waistband.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
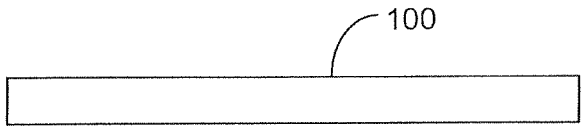
Figure 1 (Prior Art)
FIG. 1 illustrates a rectangular waistband utilized in the prior art.
Figure 2:
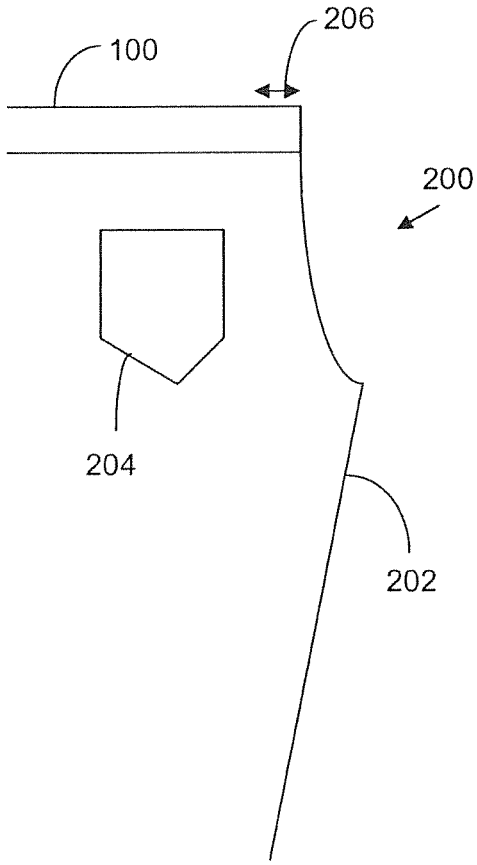
Figure 2 (Prior Art)
FIG. 2 illustrates prior art pants formed with a rectangular waistband.
Figure 3:
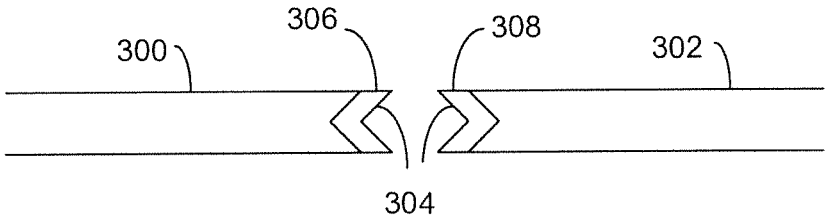
FIG. 3 illustrates two strips of material used to form a v-shaped waistband in accordance with an embodiment of the invention.

FIG. 3 illustrates a first material segment 300 and a second material segment 302. Each material segment has a v-shaped cut-out 304 at a terminal end. The v-shaped cut-out of the first material segment 300 is folded back to form a first v-fold 306. Similarly, the v-shaped cut-out of the second material segment 302 is folded back to form a second v-fold 308.

Figure 4:
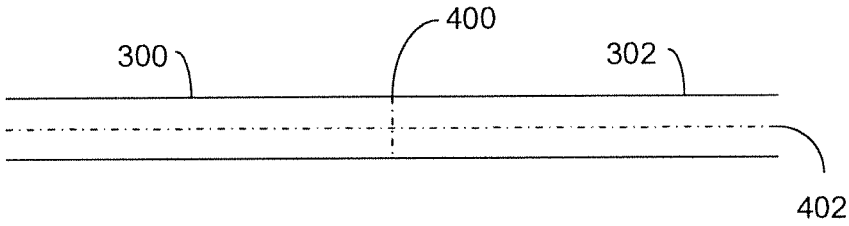
FIG. 4 illustrates the two strips of material from FIG. 3 sewn together; the figure also illustrates a fold line utilized in accordance with an embodiment of the invention.
Figure 5:
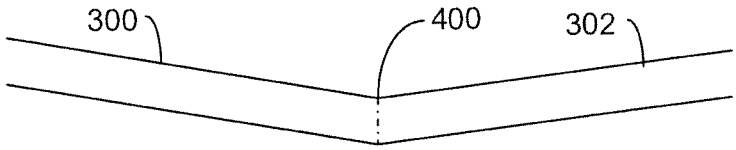
FIG. 5 illustrates the waistband of FIG. 4 after sewing and folding.

The first v-fold 306 and the second v-fold 308 are placed in a face-to-face configuration, which is sewn to form a seam 400, as shown in FIG. 4. FIG. 4 also illustrates a longitudinal axis 402 of the resultant waistband. The waistband is folded along the longitudinal axis 402 to form the waistband of FIG. 5. In particular, FIG. 5 is a rear view of the waistband. Observe that the waistband resembles a shallow v-shape.

Figure 6:
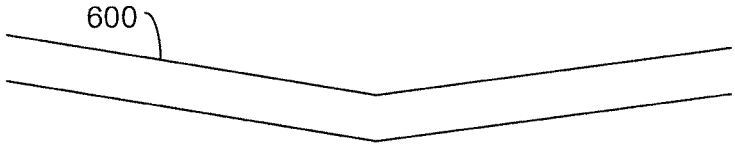
FIG. 6 illustrates a v-shaped waistband formed from a single piece of material in accordance with an embodiment of the invention.

FIG. 6 illustrates an alternate embodiment of the v-shaped waistband. In this embodiment, the material 600 is cut from a single piece of material. The single piece of material may be initially cut to form a shallow v-shape. Alternately, a rectangular strip of material may be used. In this instance, material at the center of the strip is folded and sewn to form the shallow v-shape. The two strip embodiment of FIG. 3 has the advantage of using smaller pieces of material, which may be cut from a base material in a more efficient manner to reduce material waste.

Figure 7:
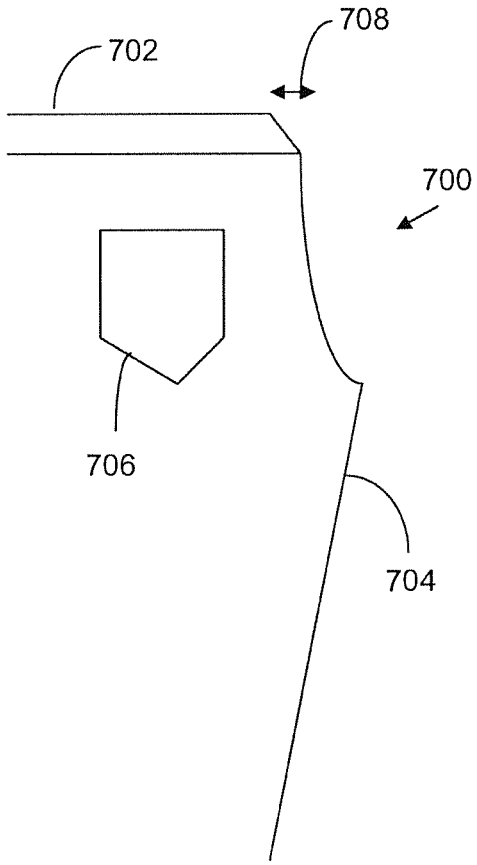
FIG. 7 is a side view of pants with a v-shaped waistband in accordance with an embodiment of the invention.

FIG. 7 is a side view of pants 700 formed in accordance with an embodiment of the invention. The figure illustrates a waistband 702, such as the waistband of FIG. 5 or FIG. 6, attached to a pant leg 704, which includes a pocket 706. Arrow 708 indicates an eliminated or reduced back gap region. In particular, the rear center region reaches toward the back of the individual (not shown) wearing the pants. The disclosed waistband results in a configuration where the top of the waistband has a slightly smaller circumference than the remainder of the waistband, thereby promoting closer engagement with the back of the individual at the top of the waistband.

Figure 8:
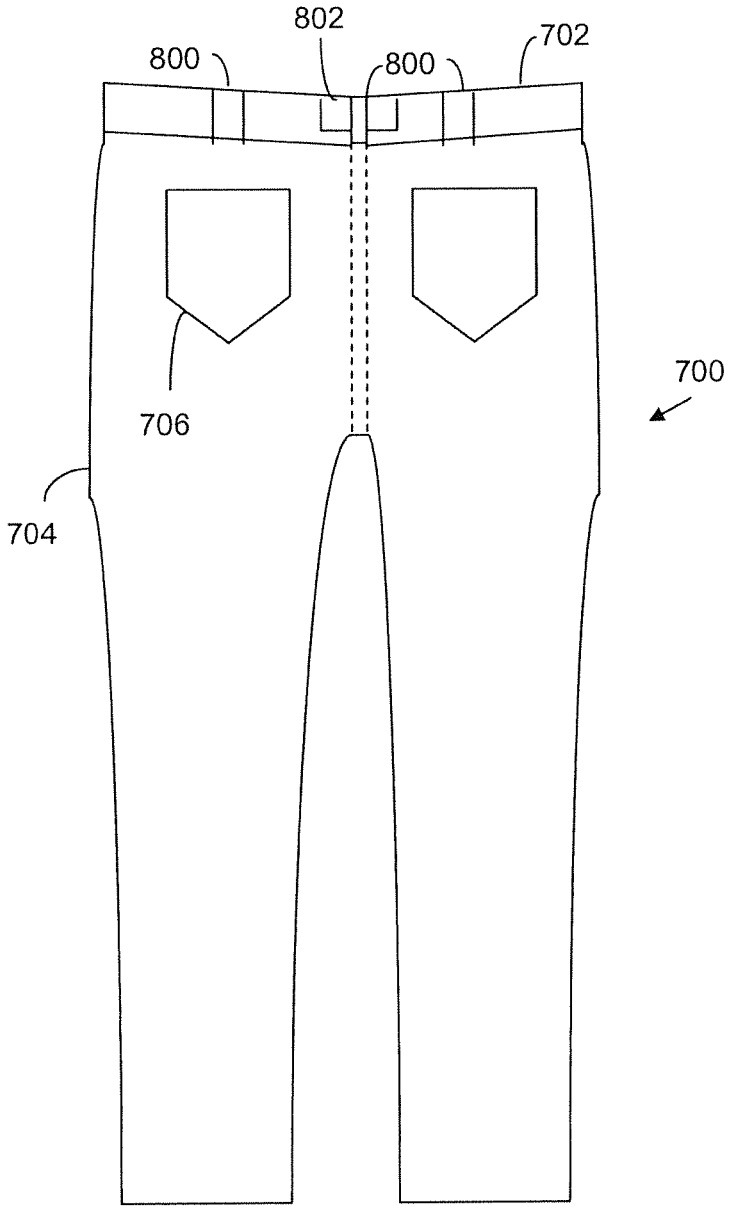
FIG. 8 is a rear view of pants with a v-shaped waistband in accordance with an embodiment of the invention.

FIG. 8 is a rear view of pants 700. Observe that the waistband 702 has a subtle v-shape descending from the hip region to the rear center region. When the pants are worn by an individual, the natural shape of the body tends to diminish the observable nature of the v-shape. Thus, an individual enjoys a reduced back gap with a contoured fit. At that same time, when worn on a body, the v-shape is barely observable, thereby creating the aesthetic appeal of a straight waistband. Another benefit of the waistband 702 is that the shape tends to align the grains of the fabric (e.g., denim) in a vertical manner.

FIG. 8 also illustrates a set of belt loops 800. In one embodiment, one or more belt loops 800 includes a reinforcement patch 802. As shown in FIG. 8, reinforcement patch 802 may be wider than belt loop 800, yet not extend along an entire circumference of waistband 702. The reinforcement patch is a piece of fabric that is attached to the front and/or back of the waistband. The top and/or bottom of the belt loop 800 is sewn to the reinforcement patch 802. The reinforcement patch provides more foundation for stitching and thereby anchors the belt loop 800 in a more secure manner. Accordingly, the belt loop 800 is harder to tear away This embodiment is particularly useful for rodeo ropers. The reinforcement patch reduces wear, tear and ripping of a belt loop when a rope is pulled in and out of the loop.

The reinforcement patch may be formed of leather, faux leather, suede or denim. The pants may also be formed from one or more of the same materials.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. Pants, comprising:

a pants body including a pair of elongate pant legs and a waistband, wherein the waistband is configured to extend around a wearer of the pants, and wherein the waistband includes a front portion configured to be positioned adjacent to a front of the wearer and a rear portion configured to be positioned adjacent to a rear of the wearer;

a reinforcement patch attached to the waistband; and a belt loop attached directly to the reinforcement patch, wherein the reinforcement patch provides a foundation for securely anchoring the belt loop to the waistband, wherein the reinforcement patch is wider than the belt loop, wherein the reinforcement patch does not extend along an entire circumference of the waistband, and further wherein the reinforcement patch is positioned over only a portion of the waistband proximate where the belt loop is attached to the waistband.

2. The pants of claim 1, wherein the reinforcement patch further increases the strength by which the belt loop is secured to the waistband when compared to a belt loop that is not secured to a reinforcement patch.

3. The pants of claim 1, wherein the reinforcement patch is positioned over only the rear portion of the waistband.

4. The pants of claim 1, wherein the reinforcement patch is positioned over only a center region of the rear portion of the waistband.

5. The pants of claim 1, wherein the waistband has an outer surface that faces away from the wearer when the wearer is wearing the pants and an inner surface that faces toward the wearer when the wearer is wearing the pants, and further wherein the reinforcement patch is attached to the outer surface of the waistband.

6. The pants of claim 1, wherein the pants further include at least one non-reinforced belt loop that is not secured to a reinforcement patch.

7. The pants of claim 1, wherein the belt loop is configured to receive and selectively retain a roping rope therein, and further wherein the reinforcement patch reduces wear, tear, and ripping of the belt loop when the roping rope is pulled in and out of the belt loop.

8. The pants of claim 1, wherein the reinforcement patch is formed from a material selected from the group consisting of leather, faux leather, and suede.

9. The pants of claim 1, wherein the reinforcement patch is formed from a material selected from the group consisting of leather, faux leather, suede, and denim.

10. The pants of claim 1, wherein the reinforcement patch is formed from leather, faux leather, or suede, and the waistband is formed from denim.

11. The pants of claim 1, wherein the pants are formed from denim.

12. The pants of claim 1, wherein the waistband has a rear center region having a shallow v-shape.

13. The pants of claim 12, wherein the waistband includes a fold that defines an upper edge of the waistband, and further wherein the upper edge of the waistband has a circumference that is smaller than a circumference of the waistband below the upper edge.

14. The pants of claim 13, wherein the waistband further includes a seam that defines an apex of the shallow v-shape.

15. The pants of claim 13, wherein the waistband is non-elastic.

16. The pants of claim 15, wherein the pants are formed from denim having a grain, and further wherein the shallow v-shape of the waistband generally aligns the grain of the denim.

17. Pants, comprising:

a pants body including a pair of elongate pant legs and a waistband, wherein the waistband is configured to extend around a wearer of the pants, wherein the waistband includes a front portion configured to be positioned adjacent to a front of the wearer and a rear portion configured to be positioned adjacent to a rear of the wearer, wherein the waistband has a rear center region having a shallow v-shape; wherein the waistband includes a fold that defines an upper edge of the waistband, wherein the upper edge of the waistband has a circumference that is smaller than a circumference of the waistband below the upper edge, and further wherein the waistband further includes a seam that defines an apex of the shallow v-shape;

a reinforcement patch attached to the waistband; and a belt loop attached directly to the reinforcement patch, wherein the reinforcement patch provides a foundation for securely anchoring the belt loop to the waistband, and further wherein the reinforcement patch is positioned over only a portion of the waistband proximate where the belt loop is attached to the waistband.

18. The pants of claim 17, wherein the reinforcement patch is wider than the belt loop, wherein the reinforcement patch does not extend along an entire circumference of the waistband.

19. Pants, comprising:

a pants body including a pair of elongate pant legs and a waistband, wherein the waistband is configured to extend around a wearer of the pants, wherein the waistband includes a front portion configured to be positioned adjacent to a front of the wearer and a rear portion configured to be positioned adjacent to a rear of the wearer, wherein the waistband has a rear center region having a shallow v-shape; wherein the waistband includes a fold that defines an upper edge of the waistband, wherein the upper edge of the waistband has a circumference that is smaller than a circumference of the waistband below the upper edge, and further wherein the waistband is non-elastic;

a reinforcement patch attached to the waistband; and a belt loop attached directly to the reinforcement patch, wherein the reinforcement patch provides a foundation for securely anchoring the belt loop to the waistband, and further wherein the reinforcement patch is positioned over only a portion of the waistband proximate where the belt loop is attached to the waistband.

20. The pants of claim 19, wherein the pants are formed from denim having a grain, and further wherein the shallow v-shape of the waistband generally aligns the grain of the denim.

21. The pants of claim 19, wherein the reinforcement patch is wider than the belt loop, wherein the reinforcement patch does not extend along an entire circumference of the waistband.

* * * * *